United States Patent [19]

Arndt et al.

[11] Patent Number: 4,646,854

[45] Date of Patent: Mar. 3, 1987

[54] HYDRAULIC STRIKING DEVICE

[75] Inventors: Friedrich-Karl Arndt, Essen; Karlheinz Fritz, Sprockhövel, both of Fed. Rep. of Germany

[73] Assignee: Fried. Krupp Gesellschaft mit beschränkter Haftung, Essen, Fed. Rep. of Germany

[21] Appl. No.: 801,966

[22] Filed: Nov. 26, 1985

[30] Foreign Application Priority Data

Nov. 29, 1984 [DE] Fed. Rep. of Germany ..... 3443542

[51] Int. Cl.[4] ..... B25D 9/18

[52] U.S. Cl. ..... 173/134; 71/300; 71/321; 71/317

[58] Field of Search ..... 173/116, 134, 135, 137; 91/285, 300, 321, 278

[56] References Cited

U.S. PATENT DOCUMENTS

| | | | |
|---|---|---|---|
| 3,322,210 | 2/1967 | Arndt . | |
| 4,172,411 | 10/1979 | Matsuda et al. | 91/300 X |
| 4,413,687 | 11/1983 | Eklof | 173/134 |
| 4,425,835 | 1/1984 | Krasnoff | 91/321 X |

FOREIGN PATENT DOCUMENTS

| | | | |
|---|---|---|---|
| 0070246 | 1/1983 | European Pat. Off. . | |
| 2428236 | 10/1975 | Fed. Rep. of Germany . | |
| 1584810 | 2/1981 | United Kingdom . | |
| 1084435 | 4/1984 | U.S.S.R. | 173/116 |
| 1102935 | 7/1984 | U.S.S.R. | 173/116 |

*Primary Examiner*—Donald R. Schran
*Assistant Examiner*—Willmon Fridie, Jr.
*Attorney, Agent, or Firm*—Spencer & Frank

[57] ABSTRACT

A hydraulic striking device (1) includes a percussion piston (3) which reciprocates in an operating cylinder (2) and strikes a bit (4). The reciprocation is governed by a control valve (10) which is connected to the operating cylinder by a control conduit (27). A holding valve (30) in the control conduit has three connections (27*a*, 27*b*, 31): one with the control valve, one with the operating cylinder, and one with the return conduit (17). The connections (27*a*, 31) which are connected with the operating cylinder and with the control conduit are axially aligned and form the outlets of a hollow cavity (53) in which a preferably spherical movable valve body (54) is disposed, the cross-sectional area of the valve body being smaller than that of the cavity. The connection (27*b*) with the control valve opens radially into the cavity. If the valve body rests against the valve seat (55) which faces the return conduit, the axis of the connection (27*b*) passes through that half of the valve body which faces this valve seat. When the striking device operates, energy that is reflected from the bit to the percussion piston can be utilized for the following stroke and thus the total performance of the striking device is increased.

4 Claims, 4 Drawing Figures

HYDRAULIC STRIKING DEVICE

BACKGROUND OF THE INVENTION

The present invention relates to a hydraulic striking device, and more particularly to a hydraulic striking device of the type that includes a pressure conduit for receiving hydraulic fluid under pressure, a return conduit for releasing the hydraulic fluid at a lower pressure, a percussion piston which is movable in an operating cylinder and which has two annular faces of different sizes and a circumferential groove between the faces, the faces being charged to move in opposite directions, a bit which is struck by the percussion piston, a valve body which is movable in a control valve and which has different sized partial faces which can be charged perpendicularly to the direction of movement, wherein the smaller face of the percussion piston is constantly connected to the pressure conduit and the larger face of the piston is alternately connected via the control valve with the pressure conduit and the return conduit, and wherein the smaller partial face of the valve body is constantly connected to the pressure conduit and the larger partial face of the valve body is alternately connected via the circumferential groove of the percussion piston with the pressure conduit and the return conduit.

Such devices are known, for example, from German Ausleggeschrift (published patent application) No. 2,428,236. In these devices, the percussion piston, before reaching either one of its two end positions, emits a control pulse of fluid which initiates the switching of a control valve which, in turn, causes the forces acting on the percussion piston to be reversed. The control pulses, which are a function of the path traversed by the percussion piston, are selected in such a manner that the percussion piston, in view of the switching delay of the control valve, on the one hand comes to rest at the intended upper reversal point and then begins its operating stroke and, on the other hand, is subjected to the forces causing the return stroke after the piston has struck the bit.

If, in the prior art striking device, striking energy is reflected from the tip of the bit, the percussion piston is accelerated in the direction of the return stroke and the control conduit, having been opened by the percussion piston, is closed again so that the switching pulse for the control valve is interrupted. The control valve then continues to remain in the position at which the percussion piston is charged toward the bit. The back-reflected percussion piston is thus decelerated and then accelerated again toward the bit. A so-called "double strike" occurs. Such double strikes are extremely undesirable and disadvantageous since, on the one hand, they effectively interfere with the quiet operation of the striking device and, on the other hand, reduce the number of strokes during which the percussion piston is accelerated from its upper or rearward reversal point.

SUMMARY OF THE INVENTION

It is the an object of the present invention to provide a striking device of such type that, in the case where the striking energy is reflected back from the tip of the bit to the percussion piston, the number of strokes is not reduced and the quiet operation of the device is not adversely affected.

This is accomplished by providing a holding valve which is disposed in the control conduit and which is connected to the control valve, the operating cylinder, and the return conduit, with the connections to the operating cylinder and return conduit being axially oriented to form outlets of a cavity or bore which has a movable valve body therein, the valve body having cross-sectional dimensions which are smaller than those of the bore. The arrangement of a holding valve in the control conduit and the attachment of the holding valve via a third connection directly to the return conduit permits the hydraulic fluid or pressure medium present in the control conduit to flow out even if, due to a control pulse, the control conduit is temporarily without pressure and the control pulse is shortly thereafter interrupted again. Thus, the control valve switches reliably in any case—even in the case where striking energy is reflected back from the bit—and, in this position, causes the operating piston to be accelerated in the direction of the return stroke until it reaches the upper reversal point. The reflected energy even produces the return stroke in a shorter period of time so that the number of strokes is increased. Until the control valve switches, the pressure medium, present above the large annular face of the percussion piston, can reach a pressure reservoir. The reflected energy thus absorbed by the pressure reservoir is available again for the next operating stroke. The device according to the present invention thus permits recovery of the reflection energy.

DESCRIPTION OF THE PREFERRED EMBODIMENT

Figures 1, 2:
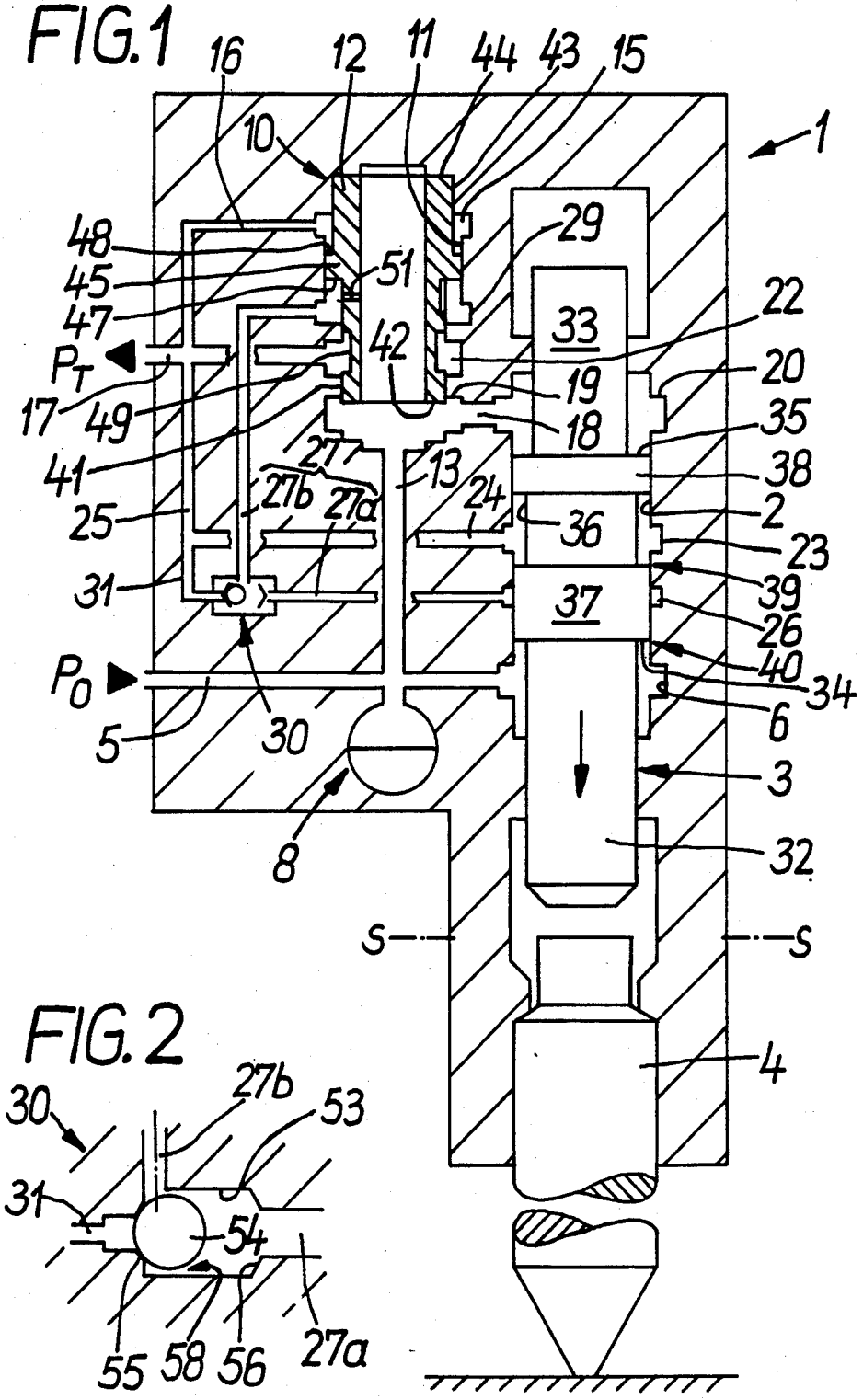
FIG. 1 is a schematic, longitudinal sectional view of a hydraulic striking device in accordance with the present invention during the operating stroke.
FIG. 2 is an enlarged view of the holding valve during the operating stroke.

Striking device 1 includes an operating cylinder 2 in which a percussion piston 3 is movably guided. A its lower end, striking device 1 is provided with a bit 4 which is held in a known manner so as to be able to slide a certain amount. The end of operating cylinder 2 facing bit 4 is connected, via a feed or pressure conduit 5, with a source of hydraulic fluid at a pressure $P_O$. Facing the mouth of the inlet of pressure conduit 5 in operating cylinder 2, there is provided an annular groove 6. Striking device 1 is further equipped with an accumulator 8 which is connected with pressure conduit 5. The accumulator 8 may be designed as described e.g. in U.S. Pat. No. 3,322,210 Arndt.

Striking device 1 further includes a control valve 10 having a control cylinder 11 and a sleeve-like control slide 12 movable therein. Control cylinder 11 has three cylindrical parts, 11*a*, 11*b*, 11*c* (see FIG. 3), with center part 11*b* having the largest diameter, lower part 11*c* having the smallest diameter and upper part 11*a* having a diameter which lies between the other two diameters. The front end of the lower cylindrical part 11*c* of control cylinder 11 is connected with pressure conduit 5 via a branch conduit 13. The upper end of control cylinder 11 is connected, via an annular groove 15 and a conduit 16, with a return flow conduit 17 (hereinafter abbreviated as "return conduit") which leads to an essentially pressureless connection (symbol: $P_T$) for releasing to hydraulic fluid.

The lower part 11*c* of control cylinder 11 is additionally connected, via a lateral conduit 18, with the upper part of operating cylinder 2, with an annular groove 19 being provided in control cylinder 11 toward the opening of conduit 18 and an annular groove 20 in operating cylinder 2. In the vicinity of groove 19, control cylinder 11 is connected via annular groove 22 directly with return conduit 17.

Between grooves 6 and 20 in operating cylinder 2, a further annular groove 23 is provided which is connected with return conduit 17 via two conduits 24 and 25. Between grooves 6 and 23, operating cylinder 2 is provided with a control annular groove 26 through which operating cylinder 2 is connected with control cylinder 11 via a control channel or a control conduit 27.

Control conduit 27 is formed by the two conduits or conduit sections 27*a* and 27*b*. In control cylinder 11, control conduit 27 opens into an annular groove 29 disposed between grooves 15 and 22. The four grooves 15, 29, 22 and 19 of control cylinder 11 define its three cylindrical parts as follows: the upper cylindrical part 11*a* lies above groove 15, the center cylindrical part 11*b* is delimited by the two grooves 15 and 29, and the lower cylindrical part 11*c* extends from the lower edge of groove 29 to below groove 19. Groove 22 lies within lower cylindrical part 11*c*.

The two conduit sections 27*a* and 27*b* are connected together by means of a holding valve 30 provided with three connections, with the third connection being connected, via a conduit section 31 and conduit 25, with return conduit 17.

Percussion piston 3 has a tapered, front or lower section 32 and a rear or upper section 33, with the diameter of front section 32 being greater than the diameter of rear section 33. Sections 32 and 33, respectively, are provided with a small annular face 34 and a large annular face 35, respectively. Between the two annular faces 34 and 35 there is disposed a recess or circumferential groove 36, forming two piston collars 37 and 38, respectively. When ready for operation, the small annular face 34 is constantly charged with a hydraulic fluid such as oil through pressure conduit 5. With its end adjacent circumferential groove 36, piston collar 37 forms an upper control edge 39 and with its end formed by the smaller annular face 34, it forms a lower control edge 40.

At its lower end facing branch conduit 13, control slide 12 is equipped with a first cylindrical section 41 having a first frontal face 42 and at its opposite end, it has a second cylindrical section 43 having a second frontal face 44. The diameter of first section 41 is smaller than the diameter of second section 43, so that first frontal face 42 also is smaller than second frontal face 44. In the operational state, both frontal faces 42 and 44 are constantly under pressure so that, via these faces, a downwardly directed force constantly acts on control slide 12, with this force resulting from the difference between surface areas ($A_{44}$–$A_{42}$) multiplied by the operating pressure $P_0$. Between sections 41 and 43 there is a piston collar 45 having an annular or control face 47 which is associated with first section 41 and a correspondingly smaller annular face 48 which is associated with second section 43. The space between groove 15 of control cylinder 11 and the second cylindrical section 43 of control slide 12 is always connected with return conduit 17.

The first section 41 of control slide 12 is guided in lower cylindrical part 11*c* and the second section 43 is guided in the upper cylindrical part 11*a* of control cylinder 11. Piston collar 45 slides in the center, cylindrical portion 11*b* of control cylinder 11.

The first cylindrical section 41 has a circumferential groove 49 and—between it and control face 47—a small radial auxiliary bore 51. The length of circumferential groove 49 is greater than the distance between the two grooves 19 and 22 in control cylinder 11.

In FIG. 2, holding valve 30 is shown to an enlarged scale. It is comprised of a hollow cylindrical cavity or bore 53 and a valve body in the form of a sphere 54. Cylindrical cavity 53 is provided with a valve seat 55 at its frontal face which is connected, via conduit section 31, with return conduit 17 and, at its other frontal face, which is connected with conduit section 27*a*, cylindrical cavity 53 is provided with a valve seat 56. Conduit section 27*b* of control section 27 opens radially into cylindrical cavity 53. If sphere 54 rests against valve seat 55, the center axis of conduit section 27*b* goes through the half of sphere 54 facing this valve seat. The diameter of sphere 54 is smaller than the diameter of cylindrical cavity 53 so that the hydraulic fluid is able to flow through the gap 58 formed by sphere 54 and bore 53.

The operation of striking device 1 will be described below for the case where the energy applied to bit 4 by percussion piston 3 is transferred completely to the pulverized material and is not reflected. FIG. 1 shows striking device 1 during the operating stroke of percussion piston 3. Above the large annular face 35, cylinder 2 is connected via conduit 18 and branch conduit 13 with pressure conduit 5. Percussion piston 3 is thus accelerated toward bit 4 by a force which is the result of the surface area difference ($A_{35}$–$A_{34}$) multiplied by the operating pressure $P_0$. During the striking or operating stroke, control slide 12 is in the upper position facing away from high pressure conduit 5 and branch conduit 13, respectively. Hydraulic fluid can flow through auxiliary bore 51 into the area below control face 47 and maintains the pressure existing there (conduit section 27*a* is covered by piston collar 37 and conduit 31 leading to return conduit 17 is covered by sphere 54 resting against the left valve seat 55). Since annular face 48 is without pressure and control face 47 is larger than the downwardly acting partial surface or difference between surface areas ($A_{44}$–$A_{42}$), control slide 12 remains in its upper position.

Shortly before piston 3 abuts on bit 4, the upper control edge 39 reaches control groove 26. Circumferential groove 36 connects conduit section 27*a*—and thus the entire control conduit 27—via conduit 24 with return conduit 17, so that the area below control face 47 becomes free of pressure. Thus the force composed of the partial area or surface area difference ($A_{44}$–$A_{42}$) is the exclusive force acting on control slide 12 and, during a valve or control period $t_{st}$, presses control slide 12 from its upper position (illustrated in FIG. 1) to its lower position (illustrated in FIG. 3). This causes the (pressure-free) hydraulic fluid to be pressed through conduit section 27*b* which, when it enters cylindrical cavity 53 of holding valve 30, impinges on the left portion of sphere 54 and flows through the gap 58 formed by sphere 54 and cavity 53 and through conduit section 27*a* to return conduit 17. The pressure difference appearing at gap 58 drives sphere 54 to the right toward valve seat 56. For a short time, the hydraulic fluid which flows out through conduit section 27*b*, can also flow out through conduit section 31 and through conduit section 27*a* as well as through conduit 24 to conduit 25 and thus to return conduit 17. If sphere 54 rests against valve seat 56, and conduit section 27*a* and conduit 24 are thus blocked for the hydraulic fluid flowing out of conduit section 27*b*, the hydraulic fluid that is displaced from control face 47 and that is being fed in through auxiliary bore 51 can continue to flow out, against a slight drop in pressure in conduit section 31, to conduit 25 and thus to return conduit 17.

Figure 3:
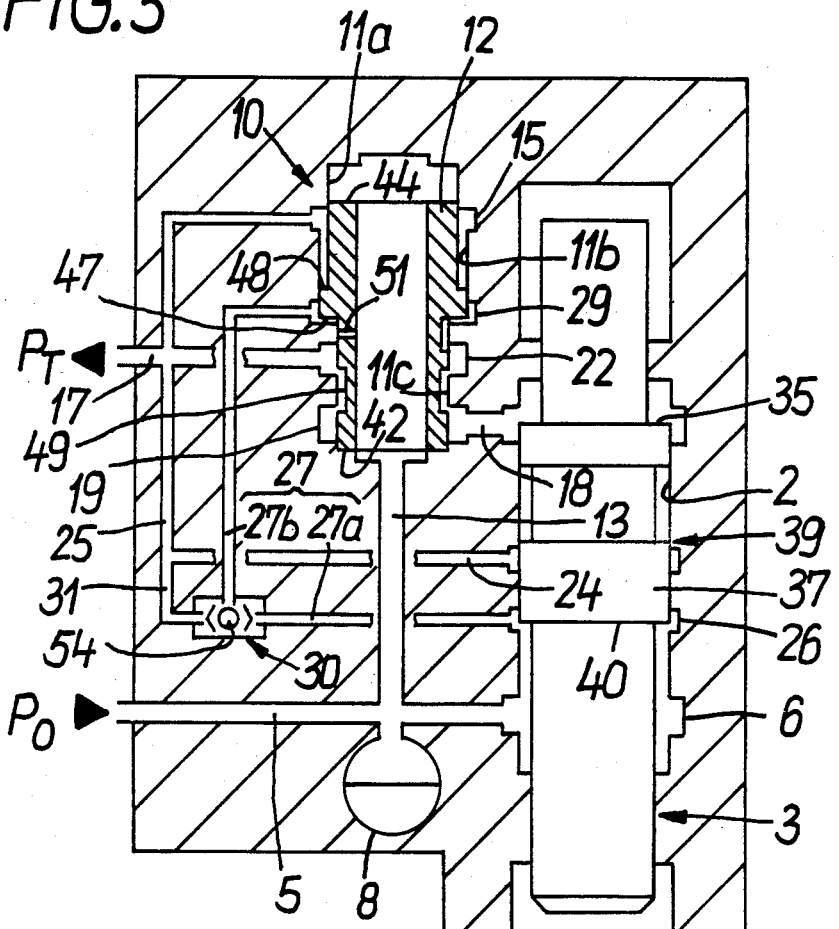
FIG. 3 is a partial longitudinal sectional view illustrating the striking device at the moment at which the control slide is disposed in the lower end position and the percussion piston has reached its upper end position at the end of the return stroke.
Figure 4:
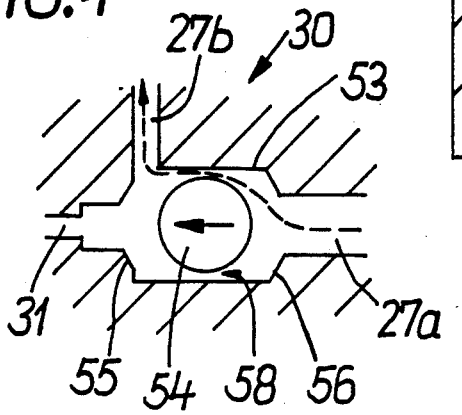
FIG. 4 shows the holding valve during a change from the right valve seat to the left valve seat after connection of the control conduit to the pressure conduit.

While control slide 12 is being moved into its lower position, auxiliary bore 51, on the one hand, is covered by that part of control cylinder 11 which is disposed between grooves 29 and 22, and circumferential groove 49, on the other hand, connects annular face 35 of piston 3 via grooves 22 and 19 as well as conduit 18 with return conduit 17 (see FIG. 3). The upper, large annular face 35 is thus relieved and percussion piston 3 is accelerated upwardly for its return stroke by the force acting on the lower, small annular face 34. Toward the end of the return stroke, the lower control edge 40 in the form of the smaller annular face 34 reaches control groove 26 and thus reestablishes a connection between pressure conduit 5 and conduit section 27*a* of control conduit 27. Sphere 54 is pressed toward the left valve seat 55 (compare FIG. 4) and the entire control conduit 27 as well as the area below control face 47 is charged with pressure so that control slide 12 is moved back into its upper position in which it reconnects, via connection conduit 13, conduit 18—which leads to operating cylinder 2—with pressure conduit 5 and initiates a new operating stroke.

For the case that the energy transmitted from percussion piston 3 to bit 4 is at least partially reflected, the reflected pulse suddenly accelerates piston 3 in the direction of the return stroke so that the time between the opening of control groove 26 via circumferential groove 36 and conduit 24 to return conduit 17 during the downward stroke of piston 3 and reclosing of control groove 26 by the upper control edge 39 is too short to bring control slide 12 into its lower position.

A small downward movement of control slide 12 may possibly be initiated but, when control groove 26 is prematurely closed because of the reflection, so that hydraulic fluid is prevented from flowing from conduit section 27*a* to conduit 24, this initial downward movement is cancelled out because auxiliary bore 51 communicates hydraulic fluid into the area below control face 47.

The short time between the opening of control groove 26 by the upper control edge 39 and the premature reclosing of groove 26 when piston 3 jumps back is, however, sufficient to lift sphere 54 from the left valve seat 55 and move it to the right. But this connects conduit section 27*b* with return conduit 17 via conduit sections 31 and 25. This connection remains intact even if control groove 26 is closed again. Control slide 12 thus performs its change of position in the same manner and during nearly the same valve or control period $t_{sf}$ as if percussion piston 3 were to release all of its energy without reflection to bit 4 and remain in the impact position S-S.

Within the control or valve period $t_{sf}$, i.e. within the period running from the connection of the annular control groove 26 by the circumferential recess 36 via the conduit 24 to the pressureless return conduit 17 to that moment, when the control slide 12 has reached its lower position, the pressurized fluid being ahead of the large annular area 35 within the operating cylinder 2 and being pushed upwards by the percussion piston 3 (which in turn is reflected or moved upwards by bit 4) can flow off through the conduits 13 and 18 into the accumulator 8. The control period $t_{sf}$ is structurally selected in such a manner that, in the case of a reflexion of the striking energy, the pressurized fluid being pushed upwards can flow off into the accumulator 8 essentially completely, that means that this energy is thereby additionally available at the following stroke. For that purpose the control or valve period $t_{sf}$ may be influenced or modified by the areas $A_{47}$ and $A_{48}$ of the control face 47 and of the annular face 48, respectively, whereby the control period $t_{sf}$ is inversely proportional to the square root of the area difference ($A_{47}$–$A_{48}$). Further elements for modifying the control period $t_{sf}$ are the stroke $s_{12}$ and the the mass $m_{12}$ of the control slide 12 as well as the operating pressure $P_0$, whereby the control period $t_{sf}$ is linear or proportional to the root of the stroke $s_{12}$ and to the root of the mass $m_{12}$ and reversely proportional to the root of the operating pressure $P_0$. For further modifying the control period $t_{sf}$ the operating pressure may be reduced by an adjustable throttle valve as described e.g. in British Patent Specification No. 1 584 810.

The hydraulic fluid flowing into pressure reservoir 8 is available for the next percussion stroke and has the same effect as an increase in the conveyed quantity $Q_0$ of fluid. Since the striking rate Z of percussion piston 3 is proportional to the conveyed quantity $Q_0$, the availability or recovery, respectively, of the reflected energy also increases the striking rate Z and thus the entire output of striking device 1.

In a modification of the described embodiment, control slide 12 can also be charged by a pressure spring in the direction toward its lower position, as disclosed, for example, in European Patent Application No. A1-0,070,246.

The operation of device 1 as described above can be summarized as follows: When piston 3 is in its upper position (the position of piston 3 in FIG. 3), an upward force is exerted on control slide 12 because the region beneath control face 47 is effectively exposed to pressure conduit 5. However when control slide 12 is in its upper position (the position of slide 12 in FIG. 1), a downward force is exerted on piston 3 because conduit 18 is effectively connected to pressure conduit 5. The result is that piston 3 begins moving downward, while slide 12 remains biassed in its upper position. When piston 3 is near its lower position (not illustrated), however, its recess 36 connects conduit section 27*a* to conduit 24. This effectively exposes the region beneath face 47 to return conduit 17, despite a slight flow of fluid through bore 51, so that slide 12 begins moving toward its lower position (the position of slide 12 illustrated in FIG. 3). When it reaches its lower position slide 12 effectively disconnects conduit 18 from pressure conduit 5 and exposes it instead to return conduit 17, so that large face 35 gets pressure-free and the operating pressure $P_0$ on face 34 of piston 3 begins moving piston 3 back to its upper position to begin the cycle anew. This operation occurs even if piston 3 rebounds when it strikes bit 4, so that conduit section 27 is disconnected from conduit 24 before slide 12 reaches its lower position. The reason for this is that sphere 54 is lifted from valve seat 55 as soon as conduit section 27*a* is connected to conduit 24 on the downward stroke of piston 3, thereby effectively connecting the region beneath face 47 to return conduit 17 until piston 3 regains its upper position.

It will be understood that the above description of the present invention is susceptible to various modifications, changes and adaptations, and the same are intended to be comprehended within the meaning and range of equivalents of the appended claims.

What we claim is:

1. A hydraulic striking device comprising:

means defining a pressure conduit for receiving hydraulic fluid at a first pressure;

means defining a return conduit for releasing the hydraulic fluid at a second pressure that is lower than said first pressure;

means for providing an operating cylinder;

a percussion piston having first and second faces of different sizes and having a circumferential groove between said faces, said first face being smaller than said second face, said piston being movably disposed in said operating cylinder with the faces thereof being charged to move in opposite directions, said first face being constantly connected to said pressure conduit;

a bit which is struck by said piston;

means for providing a control conduit having first and second sections, said first section communicating with said operating cylinder;

control valve means, communicating with said second section of said control conduit, for alternately connecting said second face of said piston with said pressure conduit and with said return conduit, said control valve means including a movably mounted valve body with first and second different sized faces which can be charged in the respective direction of movement, said first face of said valve body being smaller than said second face thereof and being constantly connected to said pressure conduit, said second face of said valve body being alternately connected with said return conduit via said circumferential groove and with said pressure conduit;

a holding valve connected to said operating cylinder via said first section of said control conduit and to said control valve means via said second section of said control conduit, said holding valve including a further valve body and means for providing a cavity in which said further valve body is movably disposed, said further valve body having a cross-section that is smaller than the cross-section of said cavity, said cavity having an axis and a pair of axially oriented outlets, one of which communicates with said first section of said control conduit; and means for providing a conduit between the other of said axially oriented outlets of said cavity and said return conduit.

2. The striking device of claim 1, wherein said further valve body is spherical.

3. The striking device of claim 2, wherein said cavity is cylindrical and said second section of said control conduit has a straight portion which opens radially into said cavity, the opening of said straight portion being disposed in the axial direction of said cavity in such a manner that, if said spherical further valve body rests against said other of said axially oriented outlets of said cavity, the axis of said straight portion passes through that half of the sphere which faces said other of said axially oriented outlets.

4. The striking device of claim 1, wherein said faces of said piston are annular and wherein said cavity is cylindrical.

* * * * *